US006039613A

United States Patent [19]

Bullard

[11] Patent Number: 6,039,613

[45] Date of Patent: Mar. 21, 2000

[54] BARRIER STRIP COVER AND BARRIER STRIP FOR POWER DISTRIBUTION PANELS

[75] Inventor: Peter Bullard, Schwenksville, Pa.

[73] Assignee: Ron Francis, Aston, Pa.

[21] Appl. No.: 09/191,644

[22] Filed: Nov. 13, 1998

Related U.S. Application Data

[60] Provisional application No. 60/065,412, Nov. 13, 1997.

[51] Int. Cl.[7] ..... H01R 9/22

[52] U.S. Cl. ..... 439/718

[58] Field of Search ..... 439/718, 892; 174/66, 67, 138 F, 101

[56] References Cited

U.S. PATENT DOCUMENTS

| | | | |
|---|---|---|---|
| 4,180,305 | 12/1979 | Ustin et al. | 174/138 F |
| 4,796,289 | 1/1989 | Masor | 379/26 |
| 4,938,715 | 7/1990 | Jones et al. | 439/621 |
| 5,215,480 | 6/1993 | Lesslie et al. | 439/709 |
| 5,249,977 | 10/1993 | Tanaka et al. | 439/135 |
| 5,899,035 | 5/1999 | Waalkes et al. | 52/239 |

*Primary Examiner*—Neil Abrams
*Assistant Examiner*—Hae Moon Hyeon
*Attorney, Agent, or Firm*—Robert S. Lipton, Esq.; Lipton, Weinberger & Husick

[57] ABSTRACT

Electrical barrier strips, such as are commonly used in power distribution panels, may utilize a variety of fasteners by which wires are connected to the strip. To prevent shorting between adjacent connectors, insulating partitions are formed between the connectors. While most barrier strips leave the tops of the connectors exposed to the environment, the present invention provides a barrier strip cover which removably snaps onto the barrier strip partitions to protect the connectors. Complimentary extensions on the base of the cover and on the top of the partitions engage each other to hold the cover to the partitions. A partition at the end of the barrier strip, which does not have any extensions, engages a groove in the bottom of the cover to align the cover over the barrier strip.

14 Claims, 6 Drawing Sheets

BARRIER STRIP COVER AND BARRIER STRIP FOR POWER DISTRIBUTION PANELS

This application is based upon United States Provisional Application No. 60/065,412 filed Nov. 13, 1997 entitled Cover For Electrical Circuit Junction Boxes.

BACKGROUND

Barrier strips are used as the interconnection devices for many types of electrical products. These strips typically have bases formed from an insulating material such as plastic with electrical connections arranged in a row along the base. The electrical connections are separated by vertical members of insulating material which prevent accidental shorting of one connector to the other. This is particularly important with screw terminal type connections, where the fastening screwdriver might accidentally slip off the screw terminal and provide a short circuit path to the next connection. Further, once the external connections are made to the barrier strip, it is important to cover the exposed connections to prevent accidental contact of the terminals. In addition, once covered, each position on the barrier strip should be marked with the appropriate circuit identification. The markings are most preferably placed on the barrier strip cover. Finally, the barrier strip covers must be easy to remove and install, particularly when visibility is poor and when connections must be made in awkward locations.

One particular application of the present invention is two power distribution panels used in automobiles. Such panels typically have many wires connected to the panel. The present invention is a barrier strip cover which snapably engages the vertical members which separate the various electrical connections along the barrier strip.

Accordingly, it is the object of the present invention to provide a barrier strip having a cover which can be easily attached with the proper orientation and easily removed.

SUMMARY OF THE INVENTION

The present invention is comprised of: 1) a barrier strip cover having extensions on its bottom surface; and 2) a barrier strip with specialized vertical isolation members which have extensions complimentary to those on the cover. The extensions on the cover and on the vertical partition snap together so that the cover is held tightly in place. The cover may be easily removed by lifting it away from the barrier strip vertical members thereby disengaging the extensions. In order to facilitate the placement or removal of the cover, the engaging extensions on the cover bottom are offset towards the rear of the cover thereby leaving a forward area which may be easily grasped. In order to align the cover with the barrier strip so that all barrier strip connections are covered by the cover, the cover is further provided with a groove near one end which is perpendicular to the covers length. This groove fits over the end vertical partition of the barrier strip thereby aligning the entire cover. The barrier strip of this invention my employ any type of connector, including, but not limited to, screw terminals, so long as the connector does not interfere with the snap closure of the cover upon the vertical members.

DESCRIPTION OF THE PREFERRED EMBODIMENT OF THE INVENTION

Figure 1:
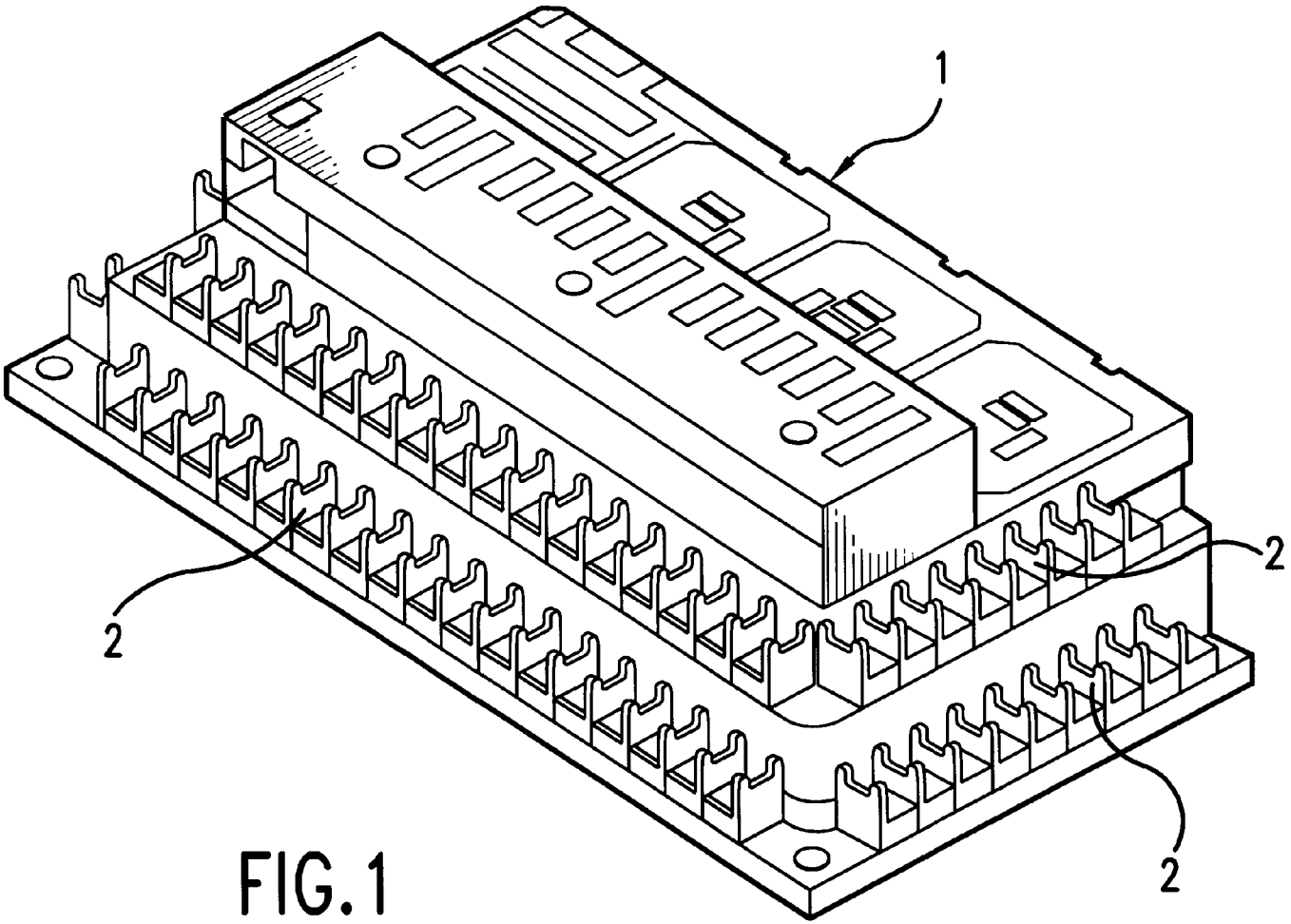
FIG. 1 shows a typical power distribution panel with rows of barrier strips on each side.

FIG. 1 shows a power distribution panel 1 having rows of barrier strips 2 designed according to the present invention on each side. The barrier strips may have any type of connection terminals between the vertical members.

Figure 2:
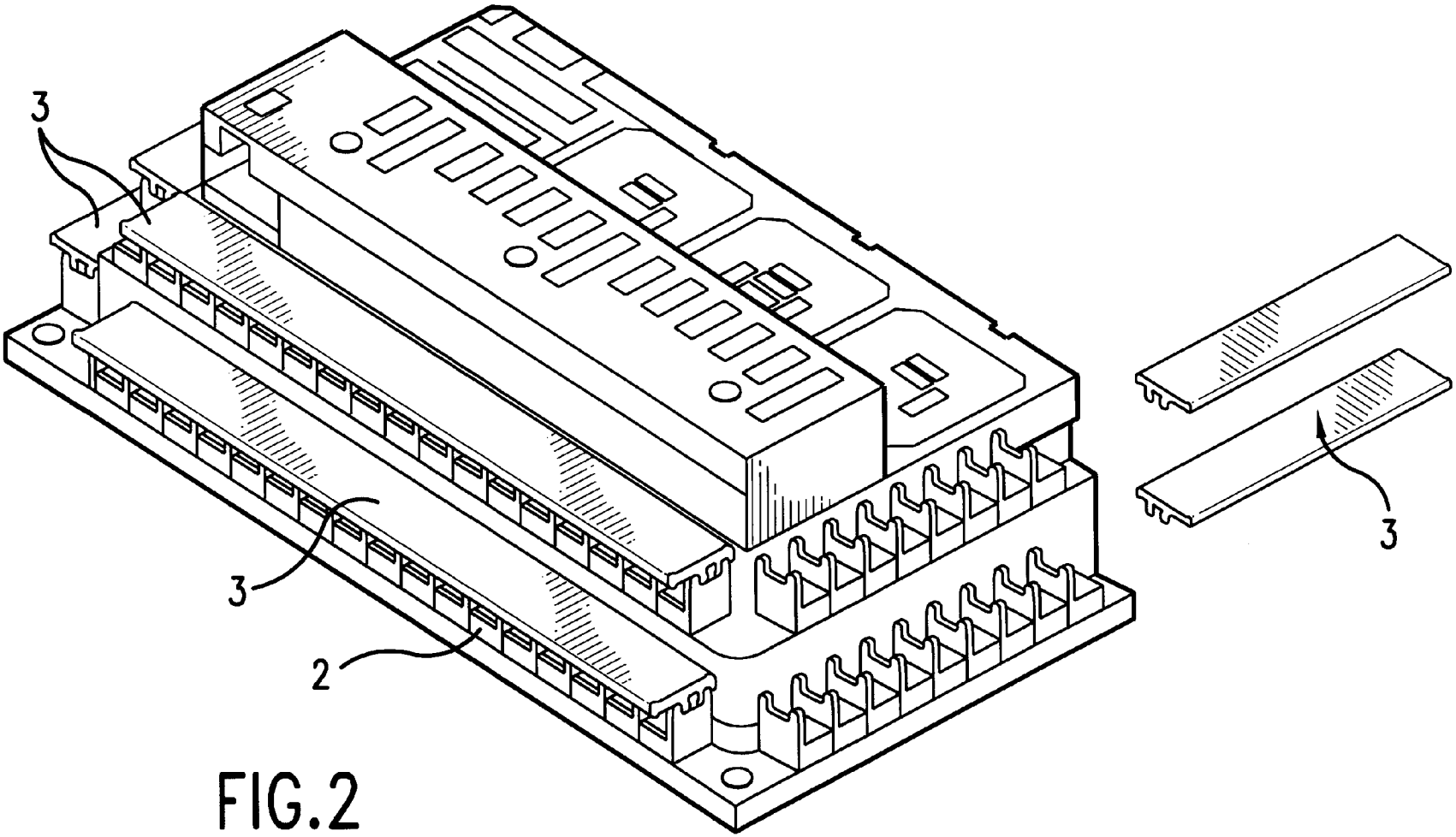
FIG. 2 shows a typical power distribution panel with some barrier strip covers in place over the barrier strip connections.
Figure 3:
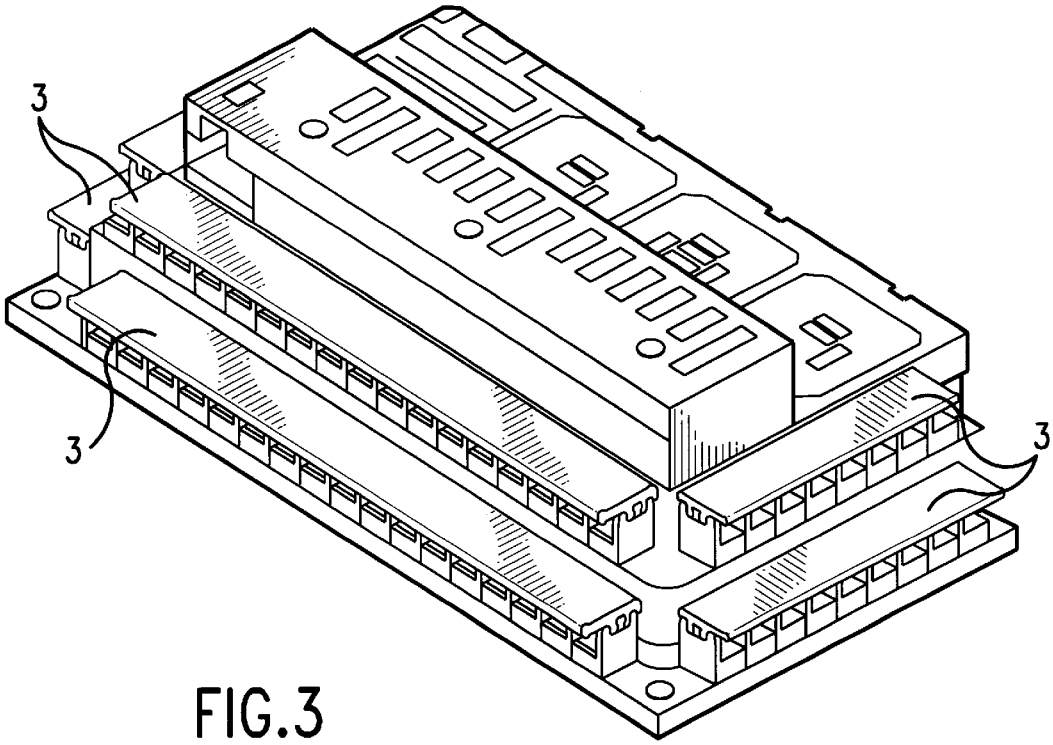
FIG. 3 shows a typical power distribution panel with the barrier strip covers in place over all the barrier strip connections.

FIG. 2 shows several of the barrier strip covers 3 in place over the barrier strips on the power distribution panel while FIG. 3 shows all of the covers in place. One important feature of the present invention which will become more apparent in the disclosure which follows is that there are no extra parts required to retain the barrier strip cover to the barrier strips. This fact inherently reduces the space required to apply the cover, and space is usually at a premium.

Figure 4:
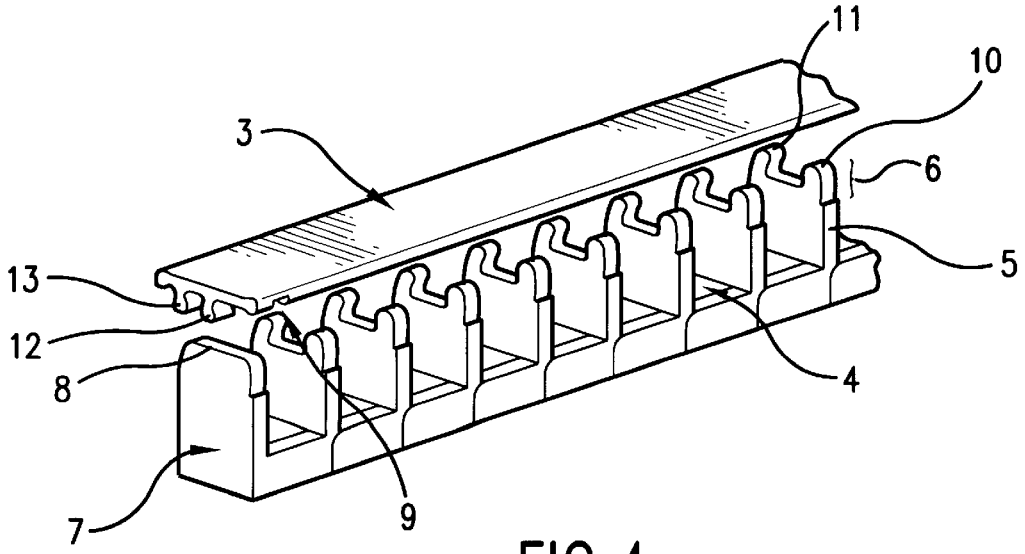
FIG. 4 shows a portion of a barrier strip with isolating separators along with the barrier strip cover.
Figure 7:
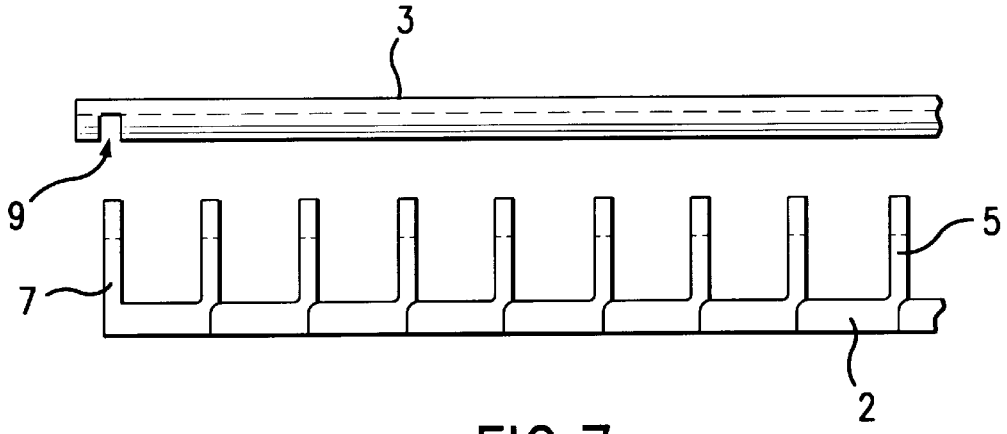
FIG. 7 shows the lengthwise alignment of the barrier strip cover with respect to the barrier strip.
Figure 8:
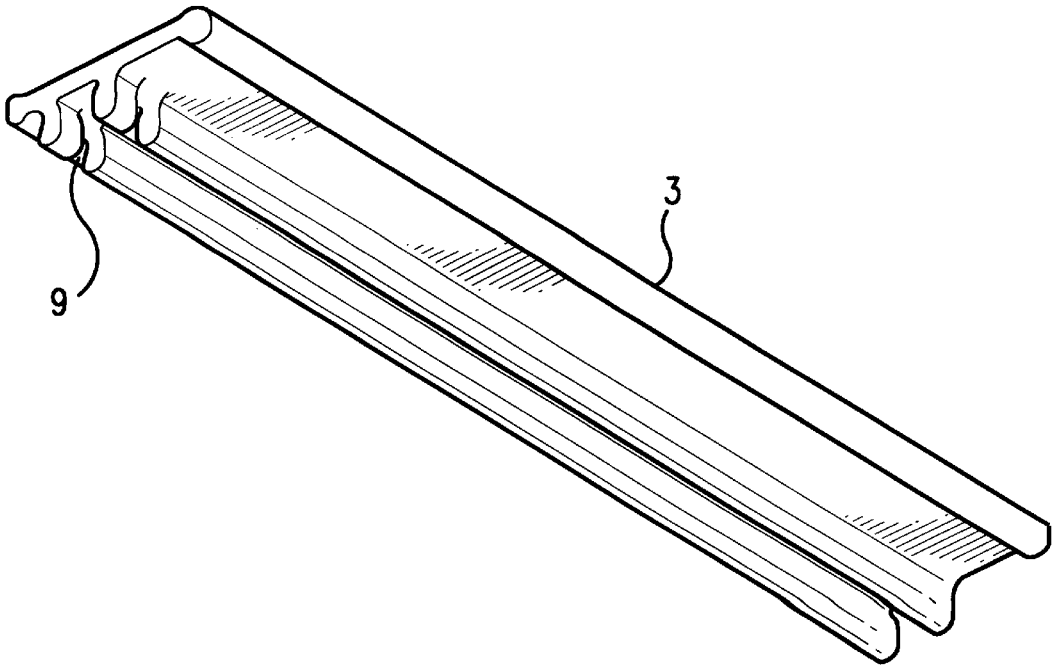
FIG. 8 shows the bottom of the barrier strip cover.

FIG. 4 shows enlarged detail of the construction of the barrier strip of the present invention. Separating each section 4 of barrier strip 2 is a vertical isolation partition 5. As will be disclosed in greater detail below, the top 6 of vertical partition 5 has formed extensions 10 and 11 adapted to snapably engage the extensions 12 and 13 on the bottom of cover 3. The vertical partition 7 on the end of the barrier strip has a top which does not have extensions 10 and 11 to snapably engage cover 3 but rather has a straight edge 8 of equal height with the top of extensions 10 and 11. Cover 3 has a groove 9 recessed into the bottom of the cover which has a width slightly greater than the width of vertical partition 7. groove 9 traverses the entire width of cover 3 and is cut through extensions 10 and 11. FIG. 8 shows groove 9 from the bottom of cover 3. Groove 9 is aligned with vertical partition 7 in order to place cover 3 onto barrier strip 2 as is shown in FIG. 7. When cover 3 is placed on barrier strip 2, the top edge 8 of vertical partition 7 fits into groove 9.

Figure 5:
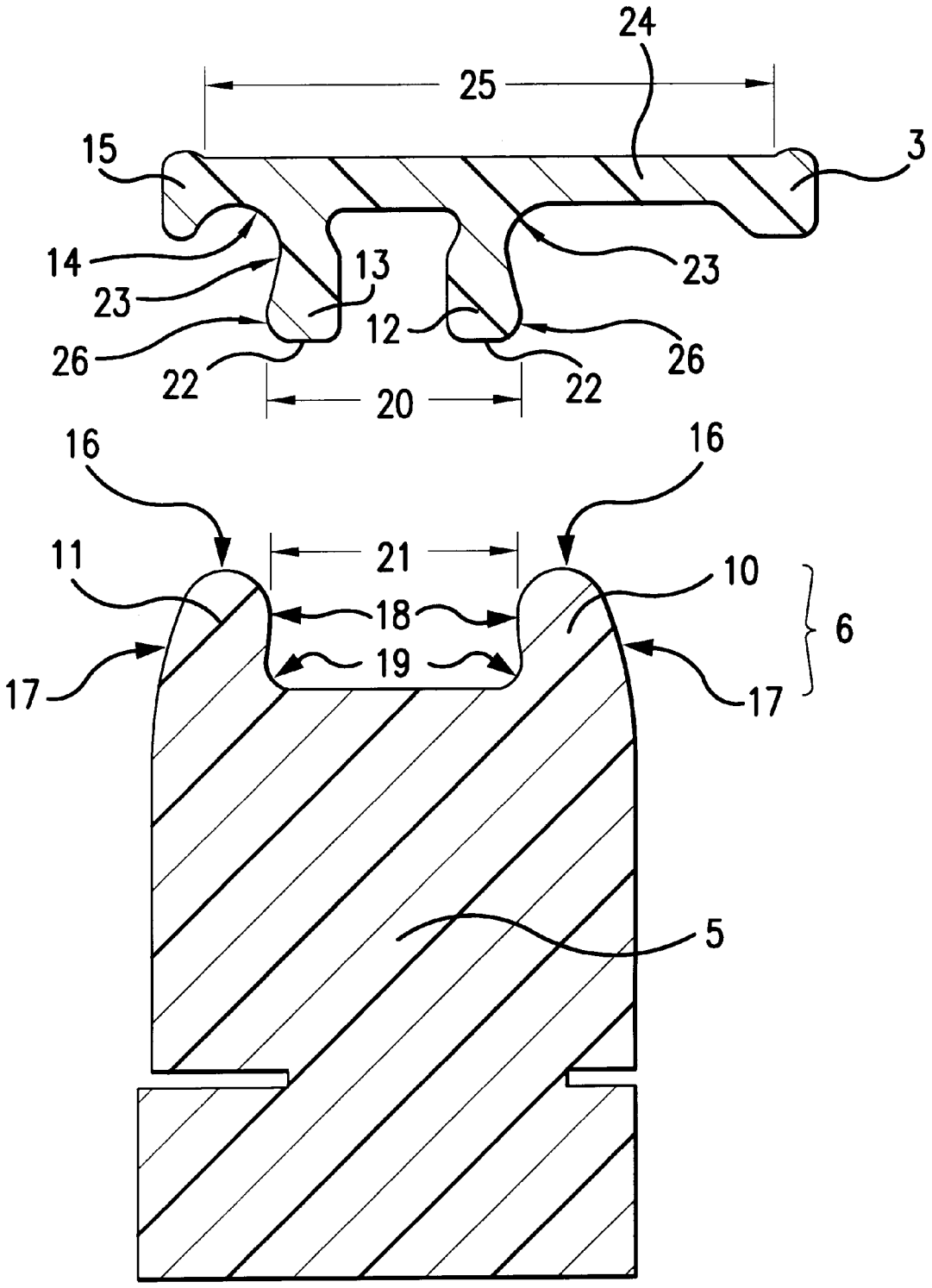
FIG. 5 shows the barrier strip and barrier strip cover in cross section and the means for snapably engaging a vertical partition with the barrier strip cover.

FIG. 5 shows in cross section one vertical partition 5 and a cover 3. Vertical partition 5 has at its top 6 a forward extension 10 and a rearward extension 11 both of which project upwards from the body of vertical partition 5. Extensions 10 and 11 have partially curved tops 16 and outside edges 17. The inside edges 18 of both extensions are slightly undercut towards their bases at 19. Cover 3 has a forward extension 12 and a rearward extension 13 each of which have partially curved bottoms 22 and are undercut slightly at 23. The shape of extensions 12 and 13 is complimentary to the shape of extensions 10 and 11; that is, the extensions are formed to fit together in close contact. In addition, the back portion 15 of cover 3 is rounded to form, along with rearward extension 13, a concave shaped receptacle 14 which is complimentary to the shape of extension 11. The distance 20 between the outer edges 26 of extensions 12 and 13 is slightly greater than the distance 21 between the inner edges 18 of extensions 10 and 11. When cover 3 is depressed onto vertical partition 5, extensions 12 and 13 engage extensions 10 and 11 forcing cover 3 to flex slightly thereby permitting extensions 12 and 13 to slide down between extensions 10 and 11, and the cover 3 and barrier strip 2 to snap together. Extension 11 is simultaneously engaged in receptacle 14. The resiliency of the material holds cover 3 tightly to barrier strip 2. Due to the resiliency of the material, the cover may also be lifted off the barrier strip by hand with only moderate force being required.

Extensions 12 and 13 are not centered on the bottom of cover 3 but rather are offset towards the rear portion 15 of cover 3. This is done so that a forward area 24 is provided with which to conveniently grasp cover 3. Typically, power distribution panels are found in locations where there is not easy access or where it is difficult to place a hand. The provision of an easily grasped cover is important in such a situation. As noted above, the placement of the cover and the removal of the cover can be accomplished by hand due to the resiliency of the material from which the cover and partitions are formed. Cover 3 is also provided with a recess 25 into which a label may be placed identifying which circuits are attached to the underlying barrier strip connections.

Figure 6:
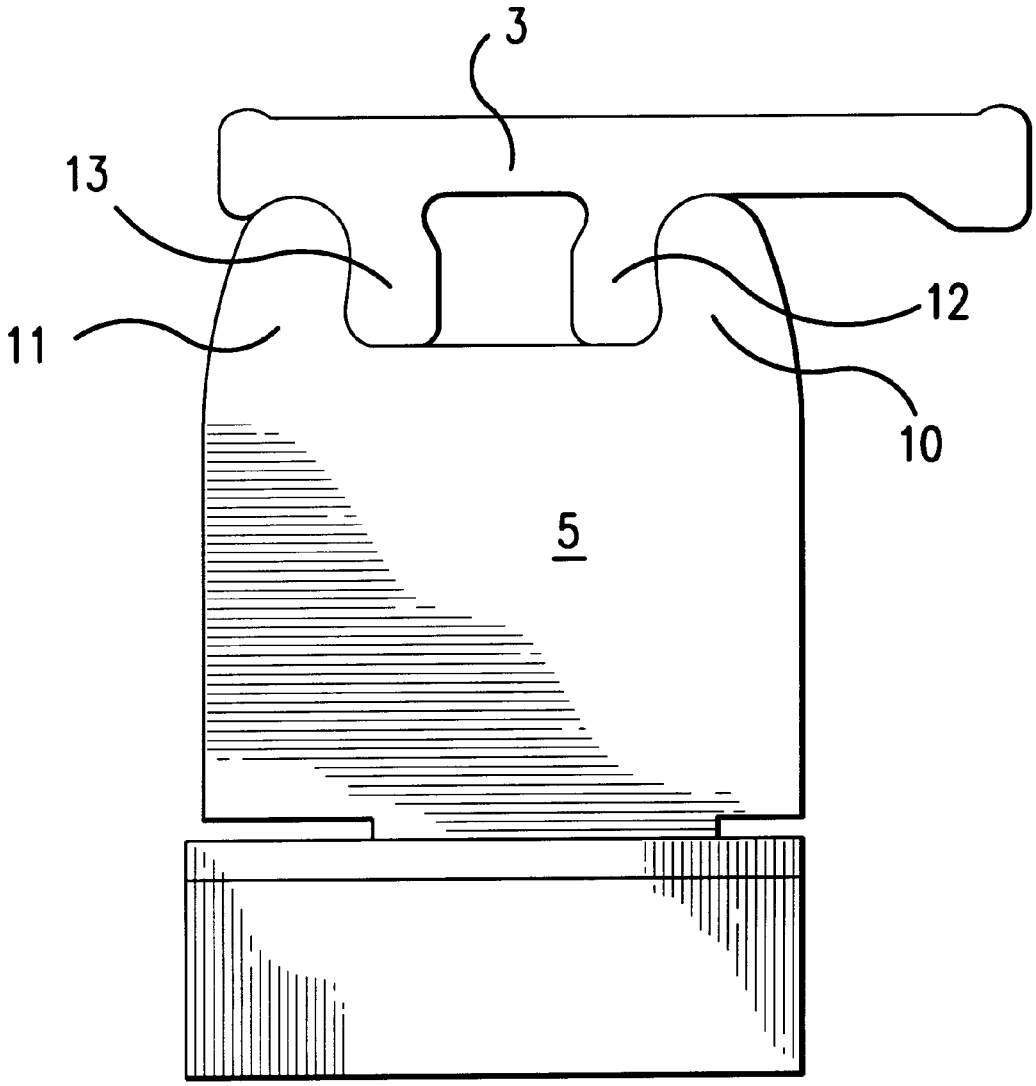
FIG. 6 shows the barrier strip cover seated in the vertical partition of the barrier strip.

FIG. 6 shows cover 3 snapped onto vertical partition 5 with extensions 10, 11, 12, and 13 engaged. Due to the position of extensions 12 and 13 as noted above, cover 3 clearly extends beyond the outside edge of barrier strip 2 for easy grasping. FIG. 7 shows groove 9 aligned over the end vertical partition 7 for alignment of cover 3 onto barrier strip 2.

An additional feature of the barrier strip of the present invention is that as a consequence of the design the forward extension 10 and rearward extension 11 can be formed without expensive cams or slides in the injection mold which forms the barrier strip. The undercut of the forward and rear extensions are designed so that they can be pulled directly from the mold. The undercut area, along with the constant reduction in size of the extension provides for easy removal of the barrier strips from the mold due to the plastic deformation of the extensions. The barrier strip cover is produced by extrusion and cut to any length required. The groove 9 is formed in the strip after its extrusion. This fabrication method is inexpensive to tool and economical to run.

In use, the groove 9 in cover 3 is aligned with the end vertical partition 7 and pressed into the extensions of the barrier strip from this groove end progressively towards the opposite end, in a motion much like a slide closure such as a zipper. Although the invention has been shown with respect to a particular embodiment, it is to be understood that various variations may be made which come within the scope of the invention.

I claim:

1. An electrical barrier strip having connectors for making contact with wires comprising:

a. a base;

b. electrical connectors secured to the base;

c. partitions extending upwards from the base above each connector and between each connector and at the ends of the base;

d. a cover;

e. a forward extension and a rearward extension, both located on the bottom of the cover for engaging the partitions between each connector, the forward cover extension and the rearward cover extension having an inner edge and an outer edge;

f. a forward extension and a rearward extension, both located on the top of each partition between each connector for engaging the bottom of the cover, the forward partition extensions having a shape complementary to the forward cover extension and the rearward partition extension having a shape complementary to the rearward cover extension, wherein the distance separating the extensions on the partitions is slightly less than the distance of the outer edges of the extensions on the bottom of the cover so that the cover extensions and partition extensions releaseably engage each other when the cover is placed upon the barrier strip;

g. means located on the cover for engaging the partition at at least one end of the base; and h. means located on the partitions at the end of the base for engaging the cover.

2. The electrical barrier strip of claim 1 in which the electrical connectors are screw terminals.

3. The electrical barrier strip of claim 1 in which the means located on the bottom of the cover for engaging the partitions between each connector further comprises a receptacle in the bottom of the cover for receiving the top end of the rearward extension on the partition.

4. The electrical barrier strip of claim 1 in which the means located on the bottom of the cover for engaging the partition at at least one end of the base further comprises a groove in the base of the cover aligned parallel to an end partition and adapted for receiving the top of an end partition.

5. The electrical barrier strip of claim 4 in which the means located on the partition at the end of the base for engaging the cover comprises the top end of the partition wherein the top end protrudes into the groove on the bottom of the cover.

6. The electrical strip of claim 1 wherein the cover has a rear area closer to the rear cover extension and a front area closer to the front cover extension, in which the forward extension and the rearward extension located on the bottom of the cover for engaging the partition between each connector are located towards the rear of the cover so that an area for grasping the cover is provided towards the front of the cover.

7. The electrical barrier strip of claim 1 in which the cover has a recess in its surface in which labels can be placed identifying the circuit connection made the connector on the barrier strip underneath the label.

8. The electrical barrier strip of claim 3 in which said receptacle on the bottom of the cover is concave-shaped and the rearward partition extension is shaped to be complementary to the concave-shaped receptacle.

9. An electrical barrier strip having connectors for making contact with wires comprising:

a. a base;

b. electrical connectors secured to the base;

c. partitions extending upwards from the base above each connector and between each connector and at the ends of the base;

d. a cover;

e. means located on the bottom of the cover for engaging the partitions between each connector;

f. means located on the top of each partition between each connector for engaging the bottom of the cover; and g. a groove in the base of the cover aligned parallel to an end partition and adapted for receiving the top of an end partition.

10. The electrical barrier strip of claim 9 further comprising an end partition of the base having a top end that protrudes into the groove on the bottom of the cover.

11. The electrical barrier strip of claim 9 wherein the cover has a rear area and a front area, in which the means located on the bottom of the cover for engaging the partition between each connector are located towards the rear of the cover so an area for grasping the cover is provided towards the front of the cover.

12. The electrical barrier strip of claim 11 wherein said rearward extension of the cover has a receptacle in the bottom of the cover for receiving the top end of the rearward partition extension.

13. The electrical barrier strip of claim 12 in which said receptacle on the bottom of the cover is concave-shaped and the rearward partition extension is complementary to the concave-shaped receptacle.

14. An electrical barrier strip having connectors for making contact with wires comprising:

a. a base;

b. electrical connector secured to the base;

c. partitions extending upwards from the base above each connector and between each connector and at the ends of the base;

d. a cover having a rear area and a front area;

e. means located on the bottom of the cover for engaging the partitions between each connector, said engaging means being located towards the rear of the cover so that an area for grasping the cover is provided towards the front of the cover;

f. means located on the top of each partition between each connector for engaging the bottom of the cover;

g. means located on the cover for engaging the partition at at least one end of the base; and h. means located on the partitions at the end of the base for engaging the cover.

* * * * *

UNITED STATES PATENT AND TRADEMARK OFFICE

CERTIFICATE OF CORRECTION

PATENT NO. : 6,039,613

DATED : March 21, 2000

INVENTOR(S) : Peter Bullard

It is certified that error appears in the above-indentified patent and that said Letters Patent is hereby corrected as shown below:

Column 4, line 42, after the word "its" insert the word -- top --

Column 4, line 43, after the word "made" insert the word -- by --

Signed and Sealed this

Twentieth Day of March, 2001

Nicholas P. Godici

*Attest:*

NICHOLAS P. GODICI

*Attesting Officer*

*Acting Director of the United States Patent and Trademark Office*